United States Patent [19]

Dubach

[11] Patent Number: 4,482,070

[45] Date of Patent: Nov. 13, 1984

[54] SAFETY CLOSURE CAP FOR BOTTLES

[75] Inventor: Werner F. Dubach, Maur, Switzerland

[73] Assignee: Alfatechnic AG, Switzerland

[21] Appl. No.: 510,222

[22] Filed: Jul. 1, 1983

[30] Foreign Application Priority Data

Jul. 2, 1982 [CH] Switzerland ..... 4045/82
Apr. 15, 1983 [CH] Switzerland ..... 2023/83

[51] Int. Cl.[3] ..... B65D 41/58
[52] U.S. Cl. ..... 215/253; 215/317
[58] Field of Search ..... 215/251, 253, 317; 220/265, 266, 258

[56] References Cited

U.S. PATENT DOCUMENTS 4,111,325 9/1978 Bellamy et al. ..... 215/253
4,180,173 12/1979 Diaz ..... 215/253
4,384,653 5/1983 Connor et al. ..... 215/253
4,402,417 9/1983 Corrigan, Jr. et al. ..... 215/253

*Primary Examiner*—George T. Hall
*Attorney, Agent, or Firm*—Thomas W. Speckman

[57] ABSTRACT

A closure cap for application to an open vessel, bottle-like container, having a narrowed neck and closed by a stopper. In the applied condition, the closure cap extends underneath the underside of a beaded rim of the neck. At least a portion of the cap bottom is detachable along a breaking line. For this purpose, the outer surface of the detachable portion is stepped with respect to the outer surface of the cap bottom or peripheral wall. A closure cap of this type is easy to apply, economical in production and effective to afford preservation of the original nature of the contents.

20 Claims, 10 Drawing Figures

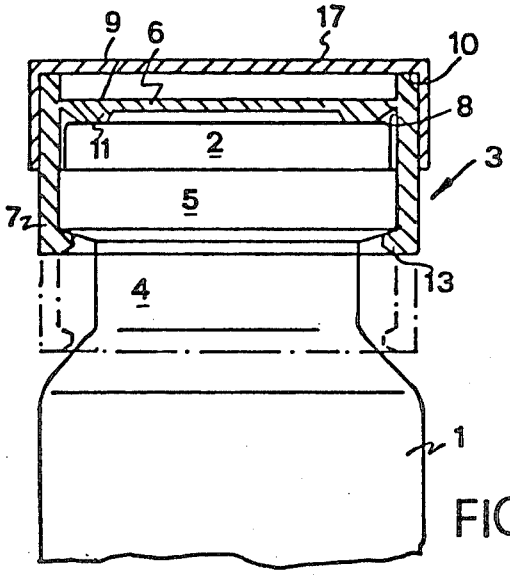
FIG. 3
FIG. 1
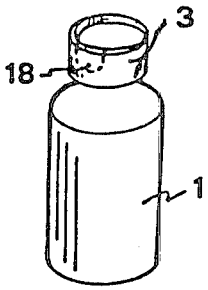
FIG. 2
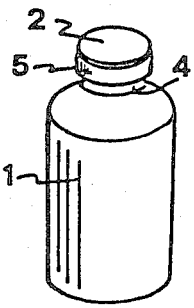
FIG. 4
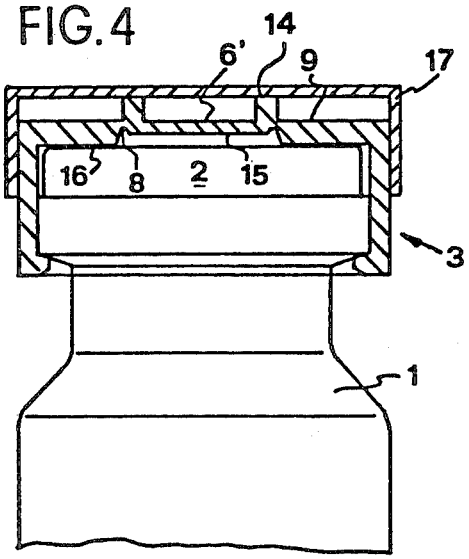
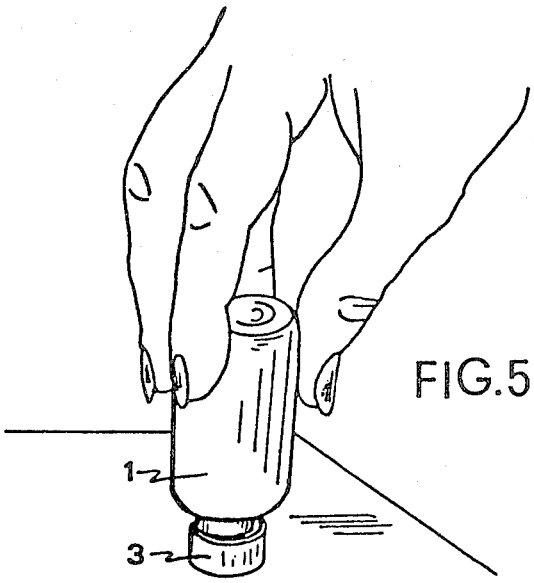
FIG. 5

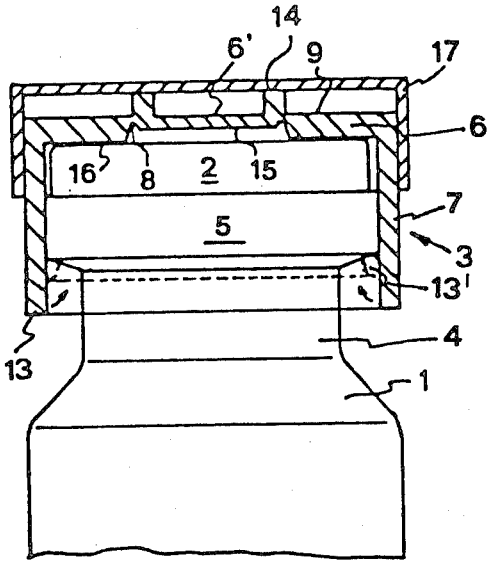
FIG. 7
FIG. 6
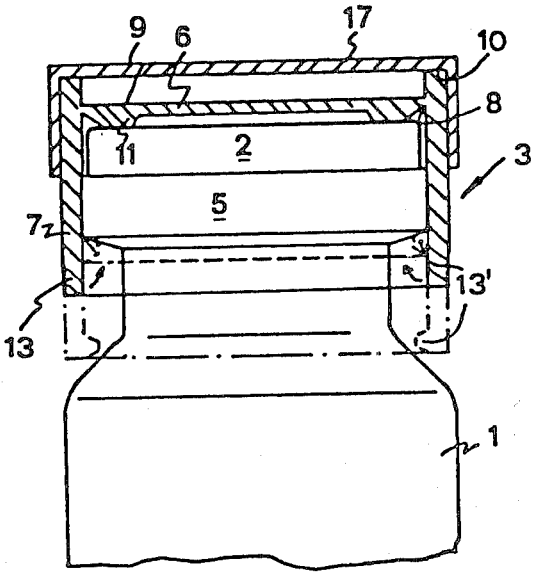
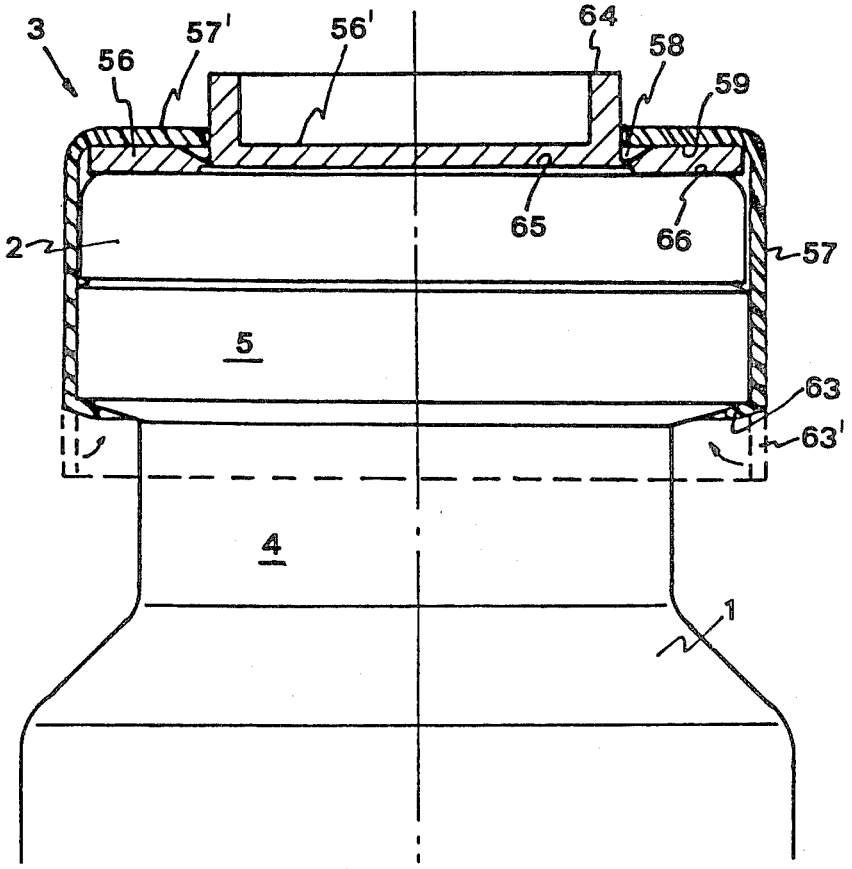
FIG. 8

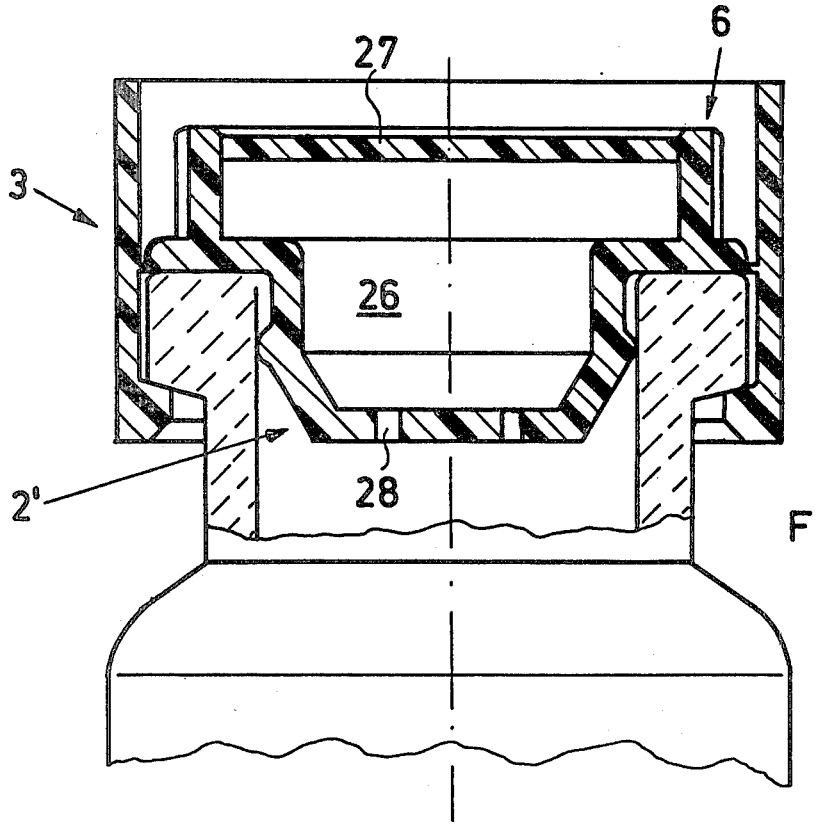
FIG. 9
FIG. 10
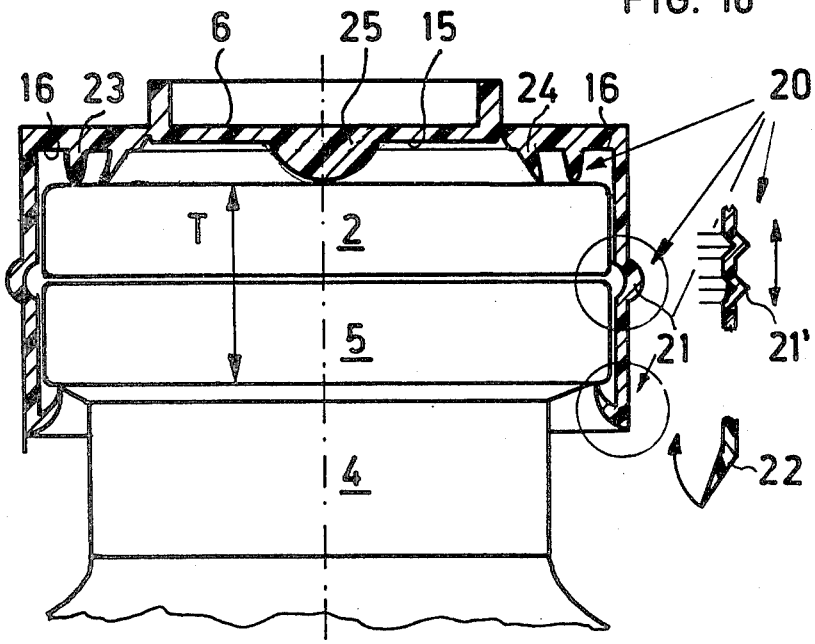
FIG. 10a
FIG. 10b

SAFETY CLOSURE CAP FOR BOTTLES

BACKGROUND OF THE INVENTION

1. Field of the Invention

The present invention relates to a closure cap, particularly a safety closure cap for bottles or similar hollow vessels having a narrowed neck which is closed preferably by a cork or stopper. The closure cap in its attached position is in sealing engagement with the lower edge of a widened portion of the neck and, for the purpose of exposing the mouth of the bottle, is provided with an at least partly detachable area.

Closure caps of the foregoing type are particularly used in the pharmaceutical industry to close bottle-like containers. Such closures have to meet certain requirements with respect to their effectiveness in providing protection of the original condition of the contents, ease of application to the bottle-like containers, ease of reopening of such containers, and, last but not least, economy of production.

2. Description of the Prior Art

These requirements are presently met by the commercially available so-called flanged closures made of aluminum and, as a rule, having a pull-open tab, only to a very limited extent. The flanging operation carried out as the closure caps are applied to the bottles is, for example, quite involved. Further, the tearing open of the closure cap is not always successful since the gripping area of the tab is relatively small so that not enough pulling force can be applied, or the material is unintentionally partly torn in an undesirable location and then cannot be severed completely so that there is a high risk of injuries caused by the sharp torn edges. Furthermore, the protection of the original condition of the bottle contents is endangered where large perforations, while facilitating the tearing open of the metallic caps, afford an opportunity for an injection needle to be inserted through such perforations into the container to ultimately reach its contents.

SUMMARY OF THE INVENTION

It is an object of the present invention to create a closure cap, particularly a safety closure cap of the foregoing type, which is capable of meeting in a satisfactory manner all of the requisite conditions. In particular, the closure according to the invention should satisfy all requirements for a mass produced product, it should be easy to apply to the containers on which it is intended to be used, it should be capable of being readily broken open, it should have a wide range of application, and it should satisfy certain hygienic and aesthetic requirements.

This is accomplished according to the invention by providing a breaking line defined by an area of reduced strength of material in the bottom of the closure cap, which area of reduced material strength surrounds a portion of the cap bottom adapted to be broken out. The outer surface of the removable portion of the cap bottom is stepped with respect to the outer surface of the peripheral wall to enable a relative displacement motion upon application of pressure to cause breaking along the break line.

The foregoing features permit the realization of a closure which will satisfy all of the aforementioned requirements. In particular, the invention permits a closure cap having a sufficient stiffness to be broken open easily while being basically independent of the material of which it is made. The breaking open of the closure cap is achieved, for example, by applying slight pressure to a bottle or ampule placed with its closure cap upon a hard surface, whereby the relative displacement motion between the detachable portion of the cap bottom and the circumferential wall takes place according to the invention, and a complete break is effected along the breaking line. As compared to presently available closures having a pull-off tab, the opening of the closure according to the present invention is simple, complete, and safe. Moreover, the closure cap has no perforations so that it contiguously surrounds the bottleneck. In addition, the visible step between the removable portion of the cap bottom and the circumferential wall is of a characteristic design and affords a pleasing aesthetic effect.

BRIEF DESCRIPTION OF THE DRAWING

The invention will be described in further detail with reference to the embodiments illustrated in the accompanying drawings, in which:

FIG. 1 is a perspective view of a glass ampule with a safety closure cap according to the invention;

FIG. 2 is a perspective view of the glass ampule of FIG. 1 prior to application of the closure cap;

FIG. 3 is a schematic sectional view of the closure of FIG. 1 as applied to the neck of the glass ampule of FIGS. 1 and 2;

FIG. 4 is a modified embodiment of the design shown in FIG. 3;

FIG. 5 is a perspective view of the breaking open procedure of the safety closure cap of FIG. 1;

FIG. 6 is a schematic sectional view of a flanged closure cap applied to the neck of a glass ampule;

FIG. 7 is a modification of the design of FIG. 6;

FIG. 8 shows another embodiment of the closure cap in an enlarged sectional view;

FIG. 9 illustrates a closure cap in which the stopper is an integral part of the removable cap portion;

FIG. 10 illustrates a closure cap with different types of resilient elements used to compensate for differences in height of the bottleneck and the stopper;

FIG. 10*a* shows a further embodiment of a resilient element; and

FIG. 10*b* shows a detail of a resilient element in the manufactured condition.

DESCRIPTION OF PREFERRED EMBODIMENTS

Referring to FIGS. 1 and 2, glass bottle or ampule 1 used for diagnosis fluids, for example, is closed with rubber stopper 2 and sealed by safety closure cap 3 according to the invention. The glass bottle or ampule 1 has narrowed neck 4 and widened or beaded rim 5. The lower edge of the beaded rim 5 is encapsuled by parts of the closure cap 3 in the attached condition, as will be more fully discussed with reference to FIGS. 3 and 4.

The closure cap 3 is advantageously made of a suitable plastic material or an aluminum alloy.

The closure cap 3 of FIG. 1, shown in an enlarged sectional view in FIG. 3, is provided according to the invention with detachable bottom 6. In order to be broken out of the closure cap 3, bottom 6 is joined to peripheral wall 7 of closure cap 3 by an area of reduced material strength in the form of line 8. To enable the bottom 6 to be broken out of the closure cap 3 along the area of reduced material strength 8, which constitutes the break line, without any tools, the invention provides for exterior surface 9 of detachable cap bottom 6 to be stepwise offset inwardly with respect to outer surface 10 of peripheral wall 7 to permit a relative displacement movement by applying pressure and thereby produce breakage along breaking line 8.

In the attached condition of closure cap 3, cap bottom 6 is positioned on top of the upper rim of neck 4 or, as in the illustrated embodiment, on the top surface of rubber stopper 2, either in its entirety or with annular shoulder 11. Thus, closure cap 3 encompasses with its peripheral wall 7 beaded rim 5 of glass bottle 1 as well as the upward flange of rubber stopper 2, and with annular beaded portion 13, provided on the inner side of peripheral wall 7, extends beneath beaded rim 5 of neck 4. Accordingly, closure cap 3 is of the snap-on type which is easy to attach to bottle 1 and which, as is shown in FIG. 3, completely and tightly encloses neck 4 with beaded rim 5 and the stopper 2.

In order to produce the relative displacement movement between cap bottom 6 and peripheral wall 7, required to break cap bottom 6 out, it is merely necessary to exert pressure upon elevated top surface 10 of peripheral wall 7 in order to push peripheral wall 7 downward, as viewed in the illustration, to slidably displace it into the region of the narrow portion of bottleneck 4 (as is indicated by the dash-dotted lines in FIG. 3), while cap bottom 6 remains in engagement with stopper 2. This causes, by necessity, bottom 6 to break out of the cap along break line 8. Since during this process stopper 2 is resiliently pushed inward a slight extent, it will, following the completion of the breaking out of the cap bottom, resiliently return to its initial position whereby the now detached cap bottom is pushed out of peripheral wall 7 and stopper 2 thus becomes freely accessible.

A simple and safe method for applying pressure to surface 10 of peripheral wall 7 requiring but little strength is to press bottle 1 with its safety closure cap 3 upside down onto a table top or the like, as is shown in FIG. 5. Applying a short downward pressing motion, or a circular pressing motion by the wrist, will result in an audible breaking action producing detachment of cap bottom 6.

Particularly, for bottles intended for multiple use, it is an advantage to provide dust cap 17 made of a plastic material which can be retentively attached to and easily detached from closure cap 3, as is clearly shown in FIGS. 3 and 4. Such dust cap 17 may, moreover, serve as a vehicle for information and for color coding, as previously mentioned.

While the closure cap described in the foregoing permits a complete exposure of the corked or stoppered mouth of bottle or ampule 1 by virtue of breaking the entire cap bottom 6 out of closure cap 3, the embodiment of FIG. 4 enables stopper 2 to remain securely in the bottle mouth after the safety closure has been broken open. To this end, interior portion 6' only of cap bottom 6 is surrounded by breaking area 8. The inner portion 6' of cap bottom 6 has outer surface 14 which extends above outer surface area 9 of cap bottom 6, and inner surface 15 which is recessed with respect to inner surface 16 of cap bottom 6. It will be apparent that here also, by applying pressure to outer surface 14, in the previously described manner, a relative slidable displacement between detachable portion 6' and the other portions of closure cap 3 takes place, such that in this instance detachable portion 6' itself is pushed toward stopper 2 and thus is broken out of the cap, whereas the peripheral wall 7 is maintained in its bottleneck enclosing condition. Again, the detached portion 6' is pushed out of the region of the fixed annular shoulder on the cap bottom by the resilient action of rubber stopper 2.

It will be appreciated that a number of modifications are feasible within the framework of the inventive concept. In particular, for example, for very short necked containers, it may be necessary to provide a lateral recessed portion or cutout 18 in the peripheral wall of closure cap 3 (FIG. 1) to push the stopper 2, covered by the closure cap, upward or remove it, respectively, after the cap bottom has been removed.

The closure caps described in the foregoing are in the form of snap caps to be applied to the bottleneck. For this purpose, the inner side of the peripheral wall of the closure cap is provided with an annular bead or ridge for engagement with the underside of the beaded rim of the bottleneck. As the closure cap is applied to the bottle by a snapping action, the peripheral wall in the area of the annular bead expands momentarily until the annular bead is in place underneath the annular beaded rim of the bottleneck with the result that the closure cap is firmly seated on the bottleneck, securely sealing the mouth of the bottle.

This requires relatively narrow tolerances as to the height of the beaded rim of the glass bottle, the height of the rubber stopper and the interior height of the closure cap. Such tolerances, however, cannot always be maintained, with the undesirable result that in extreme cases the closure cap cannot even be attached to the bottleneck, or the rubber stopper is so tightly pressed together in its center that it becomes a problem to pierce it with an injection needle.

In the embodiment of FIG. 6, cap bottom 6, in the applied condition of closure cap 3 to bottleneck 4, is positioned on the upper edge of bottleneck 4, or on the top surface of rubber stopper 2, either in its entirety or with annular shoulder 11. Thus, closure cap 3 surrounds with its peripheral wall 7 beaded portion 5 of glass container 1 and the outwardly flanged portion of the rubber stopper 2, and by annular flange 13' on the inner side of peripheral wall 7 is in engagement with the underside of beaded portion 5 of bottleneck 4, as is indicated by the broken line.

In this embodiment, annular flange 13' is formed during the sealing process from projecting edge portion 13 of peripheral wall 7 by applying a preferably controllable amount of pressure to attach closure cap 3 to the top surface of rubber stopper 2.

For a closure cap 3 made of a plastic material, this forming or molding is accomplished by the application of heat. The result is that the pressure exerted by cap bottom 6 on rubber stopper 2 is always the same, even if there are relatively great differences as to the height of rubber stopper 2 and beaded rim 5 of bottle 1. Merely the amount of material available for the molding of annular flange 13' from edge portion 13 of the peripheral wall 7 will vary, which, however, is of no consequence.

Of a similar construction is the embodiment of FIG. 7 in which, as in the embodiment of FIG. 6, the corked or stoppered mouth of ampule 1 may be exposed in its entirety by breaking the entire bottom 6 out of cap 3 while retaining stopper 2 in the bottle mouth after the safety closure has been broken open.

In the embodiment as shown in FIG. 7, only an inner portion 6' of cap bottom 6 is surrounded by break line 8. The inner portion 6' has outer surface 14 and inner surface 15 which is recessed with respect to inner surface 16 of cap bottom 6. Thus, by applying pressure to the outer surface 14 in the previously described manner, a relative displacement motion takes place between inner break-out portion 6' and the other parts of closure cap 3 in that in this instance inner break-out portion 6' itself is pushed toward stopper 2 and is thus detached, while peripheral wall 7 continues to remain in its tightly enclosing relationship with the bottleneck. Analogously, again closure cap 3 extends and curls with annular flange 13' provided on the inside of peripheral wall 7 underneath beaded rim 5 of bottleneck 4, as is indicated by the broken line.

Also in this embodiment, annular flange 13' is molded from a projecting edge portion 13 of peripheral wall 7 during the sealing process by means of a preferably controllable pressure required for applying closure cap 3 to the top surface of rubber stopper 2.

Rather than being made as a one-piece plastic part, closure cap 3 according to the invention as illustrated in the embodiment of FIG. 8, here shown without dust cap 17, has cap bottom 56 made of a plastic material and of peripheral wall 57 which in part overlaps cap bottom 56 and is made of sheet aluminum or foil. Peripheral wall 57 again extends underneath beaded rim 5 of bottleneck 4 by way of inwardly directed annular flange 63' formed on the inner side of the peripheral wall.

Similar to the embodiment of FIG. 7, inner portion 56' of cap bottom 56 is encircled by breaking area 58. Inner portion 56' has outer surface 64 projecting upward beyond outer surface 59 of cap bottom 56, and inner surface 65 which is recessed from inner surface 66 of cap bottom 56. It will be apparent that also in this embodiment a relative displacement motion between detachable portion 56' and the remaining portions of closure cap 3 is brought about by applying pressure to outer or top surface 64 in the previously described manner. Detachable portion 56' itself is pushed toward stopper 2 and thus is broken out of its confines, while peripheral wall 57 remains in its bottleneck enclosing postion. As shown in FIG. 8, the inner edge of overlapping portion 57' of peripheral wall 57 extends close to the periphery of inner portion 56' of cap bottom 56.

In this embodiment of a closure cap having peripheral wall 57 made of aluminum sheet, or the like, it is possible to apply the technique of turning under the edge or flanging which is known per se. The turned in annular flange 63' is formed by flanging from a projecting edge portion 63 of the peripheral wall 57, indicated in FIG. 8 by broken lines, resulting in application of a predetermined pressure to closure cap 3 and the top surface of rubber stopper 2.

The primary benefit obtained from providing the closure with annular flange 63' is that even large differences in the height of beaded rim 5 of bottleneck 4 and stopper 2 can be accommodated, and that an accurately defined sealing force can be established.

FIG. 10 illustrates, in combination, several different solutions to this aspect, each individual solution by itself solving the problem of the height differences.

The total distance T of the height of stopper 2 projecting above the bottle and beaded rim 5 varies in most cases only slightly so that these tolerances can be compensated by simple resilient means 20. This may be achieved, for example, by a radially extending annular resilient stretch portion 21 in peripheral wall 7. Resilient stretch portion 21 may be of various geometrical configurations. FIG. 10 shows a curved shape of resilient stretch portion 21 permitting movement in the axial direction to accommodate any height differences. If the height differences are relatively large, the resilient stretch portion may take the form of multiple annular expansion portions 21' as shown in detail in FIG. 10*a*.

An alternative to the resilient stretch portion 21 may be an edge portion 22 as an extension of peripheral wall 7. Edge portion 22 extends in the shaped condition conically inclined toward the center and tapering toward the edge (FIG. 10*b*).

As cap 3 is applied, the edge portion is turned inwardly and upwardly and thus forms resilient lip 22'.

To compensate for smaller height differences, finger-shaped resilient elements 23 are suitable which may be molded to the inner annular surface 16 of cap bottom 6. Such resilient elements 23 are capable of accommodating tolerances in the axial direction where the cap is of the type having an annular bead as shown, for example, in FIG. 3, which cap is attached by a snapping action so that it extends underneath beaded rim 5 of the bottleneck.

Instead of the finger-shaped resilient elements 23, the resilient element 20 may also be comprised of annular lips 24 concentrically surrounding the detachable portion of the cap bottom. The inclination of the sharp-edged lips 24 toward the peripheral wall 7 leads additionally to a stiffening of elastic stopper 2 making it easier for an injection needle to penetrate.

FIG. 10 also illustrates a solution to a secondary problem. In closure caps having a detachable portion of a small diameter, the removal of that portion may sometimes prove a bit troublesome. If, however, inner surface 15 of the detachable portion of cap bottom 6 is provided in its center with extension 25, elastic stopper 2 will be pushed against this extension, aiding in the ejection of the detached portion from the closure cap.

Another important embodiment is shown in FIG. 9, without leaving the basic scope of the invention.

Small bottles for powder or pill type contents may be provided with closure cap 3 in which the detachable portion of cap bottom 6 is in the form of stopper 2'. Stopper 2' forms a hollow space 26 which is closed by inset 27. Hollow space 26 serves to hold hygroscopic agents and is in communication with the interior of the bottle by way of passages or apertures 28. Similar to dust cap 17, inset member 27 may be of different colors and thus assist in the color coding of the product.

Although the closure cap is designed to be made of a plastic material, it may also be made of other materials, such as aluminum, for example, without requiring any substantial structural alterations.

The individual features of the invention as claimed in the claims may be combined in any manner, as will be obvious to those skilled in the art, within the basic scope of the invention.

I claim:

1. A closure cap for hollow vessels having a narrow neck portion having a radially extending beaded rim at the vessel opening, said closure cap in its attached position extending over said opening and beaded rim and having peripheral downwardly extending walls in sealing engagement with the lower edge of said beaded portion, said closure cap extending over said opening and having a detachable portion, said closure cap characterized by having said detachable portion defined by a breaking line (8, 58) of reduced strength of material in a bottom (6, 56) of said cap, the outer surface (9, 59) of said detachable portion of said cap bottom (6, 56) is stepped with respect to upper surface (10) of said peripheral wall (7,54), enabling a displacement motion of said detachable portion relative to said peripheral wall causing breaking along said breaking line.

2. Closure cap according to claim 1, characterized in that it is made of plastic and is constructed in the form of a snap cap to be attached by a snapping action to said neck.

3. Closure cap according to claim 2, characterized by an annular bead (13) provided on the inner side of said peripheral wall (7) and extending underneath said beaded rim of said neck.

4. Closure cap according to claim 1, characterized in that said peripheral wall (7, 57) of said closure cap (3) has an edge portion (13, 63) projecting below said beaded rim of said neck for bending so as to form a flange against the bottom of said beaded rim in the attached condition of said cap to said vessel.

5. Closure cap according to claim 4, characterized in that it is made of plastic and said edge portion (13) is heat molded by simultaneously applying heat and pressure to said closure cap (3) placed upon the top surface of a rubber stopper (2) to form undergripping annular flange (13').

6. Closure cap according to claim 4, characterized in that said cap bottom (56) is made of plastic and is encircled by said peripheral wall (57) made of sheet aluminum and partially overlapping said cap bottom (56), and that said edge portion (63) is converted into an undergripping annular flange (63') by a mechanical flanging operation in combination with pressure exerted on said closure cap (3) to apply it to the top surface of a rubber stopper (2).

7. Closure cap according to claim 6, characterized in that a detachable portion (56') of said cap bottom (56) has an outer surface (64) projecting upward from said outer surface (59) of said cap bottom (56) and an inner surface (65) which is recessed from the inner surface (66) of said cap bottom (56), with the inner edge of an overlapping portion (57') of said peripheral wall (57) extending closely up to the periphery of said detachable portion (56') of said cap bottom (56).

8. Closure cap according to claim 1, characterized in that said reduced strength material forming said breaking area is defined by a notch (8) in the material.

9. Closure cap according to claim 1, characterized in that said cap bottom (6) is offset inwardly with respect to said peripheral wall (7) and is joined to said peripheral wall by said area of reduced strength material (8).

10. Closure cap according to claim 1, characterized in that said detachable portion of said cap bottom (6) has a surface (14) extending beyond said outer surface (9) of said cap bottom (6) and an inner surface (15) which is recessed with respect to the inner annular surface (16) of said cap bottom (6).

11. Closure cap according to claim 1, characterized by having retentively attached removable dust cap (17) made of plastic.

12. Closure cap according to claim 1, characterized by having at least one lateral cutout (18) in said peripheral wall (7).

13. Closure cap according to claim 1, characterized in that said closure cap is entirely made of aluminum and is applied to said neck in a tightly sealing relationship.

14. Closure cap according to claim 2, characterized in that an annularly extending resilient stretch portion (21) is provided in said peripheral wall (7) to produce a resilient action in the axial direction.

15. Closure cap according to claim 2, characterized in that a resilient element in said peripheral wall is defined by an edge portion (22) which extends conically toward the center.

16. Closure cap according to claim 10, characterized in that axially effective resilient elements (23) are provided on said inner annular surface (16) of said cap bottom (6).

17. Closure cap according to claim 16, characterized in that said resilient elements extend concentrically around said detachable portion of said cap bottom (6) and are inclined toward said peripheral wall (7).

18. Closure cap according to claim 1, characterized in that an extension (25) is provided in the center of the inner surface (15, 65) of said detachable portion of said cap bottom (6, 56).

19. Closure cap according to claim 1, characterized in that said detachable portion of said cap bottom (6, 56) is comprised of a stopper (2') fitting within said opening as an integral part of said cap (3).

20. Closure cap according to claim 19, characterized in that said stopper (2') has a hollow space (26) for holding a hygroscopic medium and is closed by an inset member (27).

* * * * *